US006700083B2

(12) United States Patent
Konda

(10) Patent No.: US 6,700,083 B2
(45) Date of Patent: Mar. 2, 2004

(54) BREAKER APPARATUS

(75) Inventor: Kazumoto Konda, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 24 days.

(21) Appl. No.: 10/098,435

(22) Filed: Mar. 18, 2002

(65) Prior Publication Data

US 2002/0140534 A1 Oct. 3, 2002

Related U.S. Application Data

(60) Provisional application No. 60/350,186, filed on Nov. 2, 2001.

(30) Foreign Application Priority Data

Mar. 19, 2001 (JP) ..... 2001-078666

(51) Int. Cl.[7] ..... H01R 4/50
(52) U.S. Cl. ..... 200/51.09; 439/347
(58) Field of Search ..... 200/51.1, 51.09; 439/299, 310, 347, 157, 488, 489, 188

(56) References Cited

U.S. PATENT DOCUMENTS 3,801,757 A * 4/1974 Carissimi et al. .... 200/51.09 X
5,575,676 A * 11/1996 Tsukakoshi et al. ..... 439/347
6,213,791 B1 * 4/2001 Kodama ..... 439/157
6,244,880 B1 * 6/2001 Fukase et al. ..... 439/157

FOREIGN PATENT DOCUMENTS

JP A 2000-235824 8/2000

* cited by examiner

*Primary Examiner*—Renee Luebke
(74) *Attorney, Agent, or Firm*—Oliff & Berridge, PLC

(57) ABSTRACT

A breaker apparatus which has a pair of fixed electrodes in a fixed-side housing and a movable electrode in a movable-side housing. The fixed electrodes and the movable electrodes are brought into contact and separated from each other by a guide that allows the housings to move toward and away from each other. A pin in the fixed-side housing mates with a groove in a drive member that is part of the movable-side having to assist in the movement of the housings when the device member is moved in the appropriate direction.

3 Claims, 6 Drawing Sheets

BREAKER APPARATUS

This application claims benefit of provisional application Serial No. 60/350,186 Filed Nov. 2, 2001

BACKGROUND OF THE INVENTION

1. Field of Invention

The present invention relates to a breaker apparatus which fits a movable electrode with a pair of fixed electrodes and separates the movable electrode from the pair of fixed electrodes to thereby open and close a circuit.

2. Description of Related Art

In a breaker apparatus of this type, for example, there is known a breaker apparatus which is disclosed in JP-A-2000-235824. According to this breaker apparatus, a fixed-side housing, including a pair of mutually insulated fixed electrodes, is fitted with a movable-side housing including a movable electrode to thereby short-circuit a pair of fixed electrodes. By pulling a handle disposed on the movable-side housing, the movable-side housing is separated from the fixed-side housing to thereby remove the short-circuit between the pair of fixed electrodes.

However, in this breaker apparatus, when separating the movable-side housing, an operator holds the handle by hand and separates the movable-side housing at a stretch with all his or her strength. This means that, on the back surface side (on the opposite side to the fixed-side housing) of the movable-side housing, there is a relatively large operation space required in the fitting and separating direction of the two housings. Therefore, when sufficient operation space cannot be secured, for example, in a space within an engine room of an automobile, it is difficult to install the above-mentioned breaker apparatus.

SUMMARY OF THE INVENTION

To solve the above problem, the present applicants have proposed a breaker apparatus having the following structure. In this breaker apparatus, a driven pin is disposed in a fixed-side housing in a movable-side housing a drive member is disposed which is prevented from moving in the two-housing fitting direction but is allowed to move in a direction at right angles to the fitting direction. The drive member includes an inclined groove which is inclined with respect to the moving direction of the drive member. When the two housings are made to approach each other to thereby bring the driven pin into engagement with the entrance of the inclined groove and the drive member is moved from this engaged state, due to the engagement between the inclined groove and driven pin, the movable-side housing is pulled near to the fixed-side housing so that the two housings are fitted with each other. Also, when the drive member is moved from the fitted state in the opposite direction to the fitting direction, due to the engagement between the inclined groove and driven pin, the movable-side housing is separated from the fixed-side housing. In this manner, when removing the two housings from each other, by using a cam action due to the engagement between the inclined groove and driven pin, the movable-side housing can be separated from the fixed-side housing with a small operation force.

Further, in the present breaker apparatus, the fixed electrodes are disposed in an intermediate portion of a power circuit of an electric car and are used as a means to break the power circuit. In this structure,.when the movable electrode is suddenly removed from the fixed electrodes while the power circuit is electrically energized to thereby open the power circuit, there occurs an arc. In view of this, there can be expected the following structure: a relay circuit serving as switching means for opening and closing the power circuit, and a microswitch serving as a detect means which detects the movement of the drive member to thereby operate the relay circuit.

According to this structure, in a state where the two housings are fitted with each other and the fixed electrodes are fitted with the movable electrode (in a state where energization is permitted between the pair of fixed electrodes), the relay circuit executes its closing operation to thereby close the power circuit. When the movement of the drive member to separate the two housings from each other is started, just after the start of the movement of the drive member, the movement of the drive member is detected by the microswitch, and the relay circuit is allowed to execute its opening operation to thereby open the power circuit. When the movement of the drive member is moved further, the movable electrode is separated from the fixed electrodes and since the power circuit is already opened by the relay circuit, occurrence of the arc between the electrodes can be prevented.

However, between the start of the opening operation of the relay circuit and the time when the opening operation is completed and the energization of the power circuit stops, there exists a time lag (of the order of 150 msec.). Therefore, to prevent the occurrence of the arc, from the start of the opening operation of the relay circuit to the time when the fixed and movable electrodes are separated from each other, there is necessary the time that is longer than the above time lag.

Here, the moving operation of the drive member from the fitted state of the two housings (i.e., the closed state of the power circuit) to the time when the opening operation of the relay circuit is started and, after then, the fixed and movable electrodes are separated from each other is a linear-shaped one-action operation to be executed in a direction at right angles to the fitting direction of the two housings. Therefore, when the drive member is operated with great force, there is a fear that, although the opening operation of the relay circuit is not completed but the power circuit remains closed, the movable electrode can be removed from the fixed electrodes.

The present invention aims at eliminating the drawbacks found in the above-mentioned conventional breaker apparatus. Accordingly, it is an object of the invention to provide a breaker apparatus which can prevent the movable electrode from being separated from the fixed electrodes while a main circuit remains closed.

In attaining the above object, according to a first aspect of the invention, there is provided a breaker apparatus having a pair of fixed electrodes disposed in series in a main circuit to be opened and closed by switching means. The breaker apparatus also includes a movable electrode disposed in a movable-side housing that is fitted with and separated from the pair of fixed electrodes to thereby allow or prevent energization between the pair of fixed electrodes independently of the opening and closing operation of the switching means. The breaker apparatus further comprises a guide means for guiding a fixed-side housing, with the pair of fixed electrodes disposed therein, and a movable-side housing, with the movable electrode disposed therein, in the fitting and separating direction of the movable electrode and fixed electrodes. A driven pin is disposed in the fixed-side housing and a drive member is disposed in the movable-side housing in such a manner that it is prevented from moving in the fitting and separating direction of the movable electrode and fixed electrodes and it is allowed to move in a direction at right angles to the electrode fitting and separating direction. An inclined groove formed in the drive member has a base end portion open on the side edge thereof opposed to the fixed-side housing, and inclined with respect to the moving direction of the drive member. A loose fit groove is formed in the drive member and, while the fixed-side electrodes and movable electrode are fitted with each other, extends in parallel to the moving direction of the drive member from a terminal end portion of the inclined groove where the driven pin is situated. A detect means which, when the drive member is present at an energization allowable position for positioning the driven pin in the loose fit groove, allows the switching means to execute its closing operation to thereby close the main circuit, and also which, in a process where the drive member moves from the energization allowable position to an energization preventive position for positioning the driven pin in the terminal end portion of the inclined groove, allows the switching means to execute its opening operation to thereby open the main circuit.

According to a second aspect of the invention, the drive member includes a protect portion which, while the fixed electrodes and movable electrode are fitted with each other, is situated to cover the detect means.

According to a third aspect of the invention, when the drive member moves from the energization allowable position to the energization preventive position, the detect means starts the opening operation of the switching means before the drive member reaches the energization preventive position, characterized by operation resistance increasing means which, as the drive member moves to the energization prevented position side after the switching means starts the opening operation, increases the operation resistance of the drive member.

According to the first aspect of the invention, when the drive member is moved with the driven pin engaged with the base end portion of the inclined groove, the two housings approach each other while they are guided by the guide means. When the drive member reaches the energization preventive position, not only the fitting engagement between the two housings but also the fitting engagement between the fixed and movable electrodes are completed and energization is allowed between the pair of fixed electrodes. When the drive member is moved to the energization allowable position, the switching means executes its closing operation to thereby close the main circuit, so that energization between the fixed electrodes is allowed. In a process where the drive member is moved in the opposite direction from this state, the driven pin moves within the loose fit groove during the movement of the drive member from the energization allowable position to the energization preventive position. Therefore, the opening operation of the switching means is executed while the fixed and movable electrodes remain unmovable with respect to each other in the separating direction (i.e., while maintaining their mutual fitting engagement), so that the main circuit is opened.

When the drive member is moved further, the movable electrode is separated from the fixed electrodes to thereby prevent energization between the pair of fixed electrodes. In this manner, according to the first aspect of the invention, due to provision of the loose fit groove, the opening operation of the switching means for opening the main circuit can be completed while maintaining the mutual fitting engagement between the fixed and movable electrodes.

According to the second aspect of the invention, since there is formed in the drive member the protect portion for covering the detect means, the detect means can be prevented from being operated unpreparedly due to interference by external foreign bodies. Thus, the unprepared execution of the opening operation of the switching means for opening the main circuit can be prevented.

According to the third aspect of the invention, due to provision of the operation resistance increasing means, as the drive member moves to the energization preventive position side after the opening operation of the switching means starts, the operation resistance of the drive member can be increased. Thanks to this, as the time that is necessary from the start of the opening operation of the switching means to the separation of the movable electrode from the fixed electrodes, there can be secured sufficiently long time.

DETAILED DESCRIPTION OF THE PREFERRED EMBODIMENTS

A description will be given below of a first embodiment of a breaker apparatus according to the invention with reference to FIGS. 1 to 7.

In a breaker apparatus according to the present embodiment, a pair of fixed electrodes 13 are disposed in a fixed-side housing 10 and arranged in series with a main circuit (not shown) to be opened and closed by a relay circuit (not shown) (switching means which is an element of the invention). Two movable electrodes 23 are disposed in a movable-side housing 20 and are fitted with and separated from the pair of fixed electrodes 13, thereby permitting or preventing electric energization between the pair of fixed electrodes 13 independently of the opening and closing operations of the relay circuit.

Figure 1:
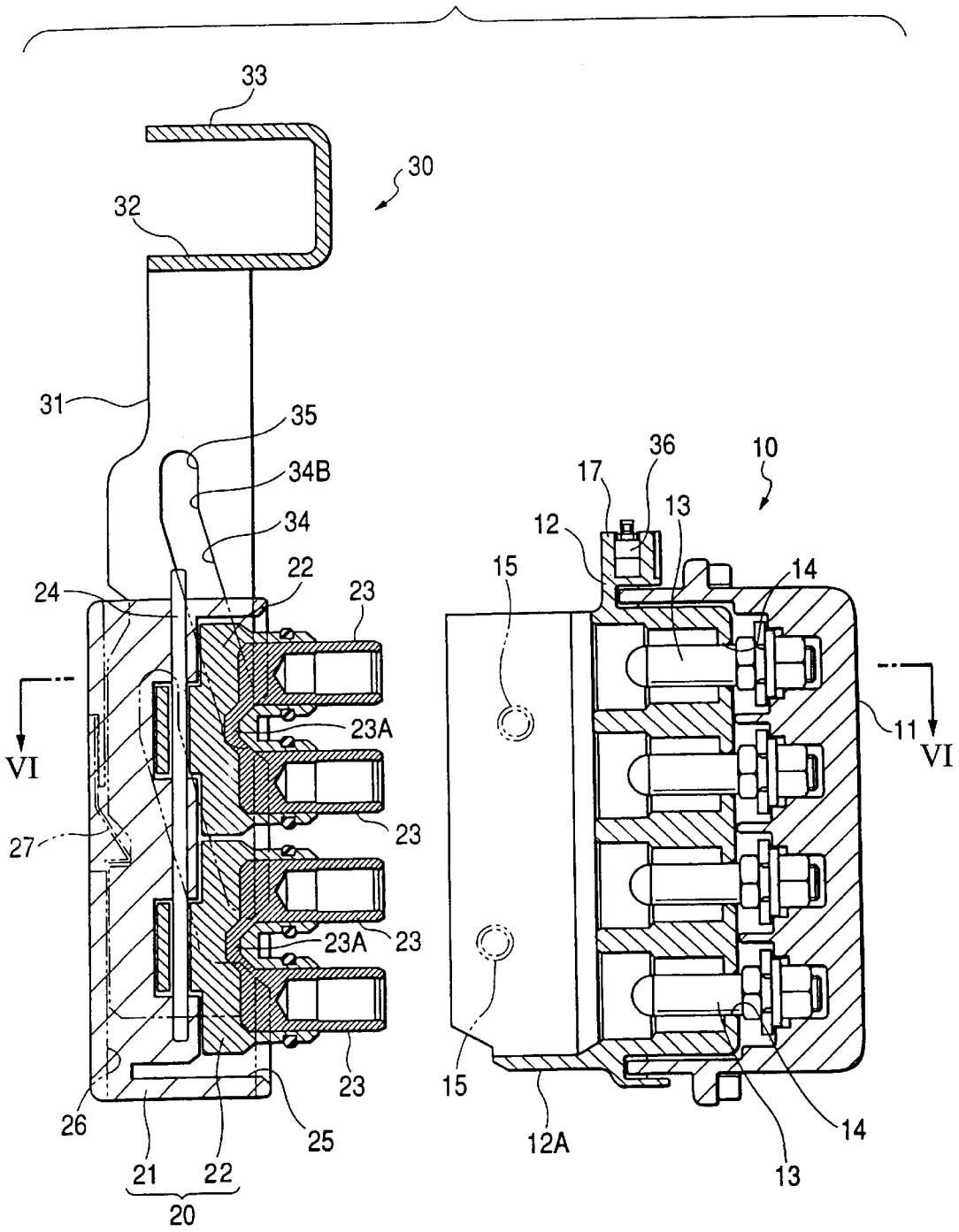
FIG. 1 is a section view of a breaker apparatus according to a first embodiment of the invention, showing a state in which two housings are separated from each other.
Figure 2:
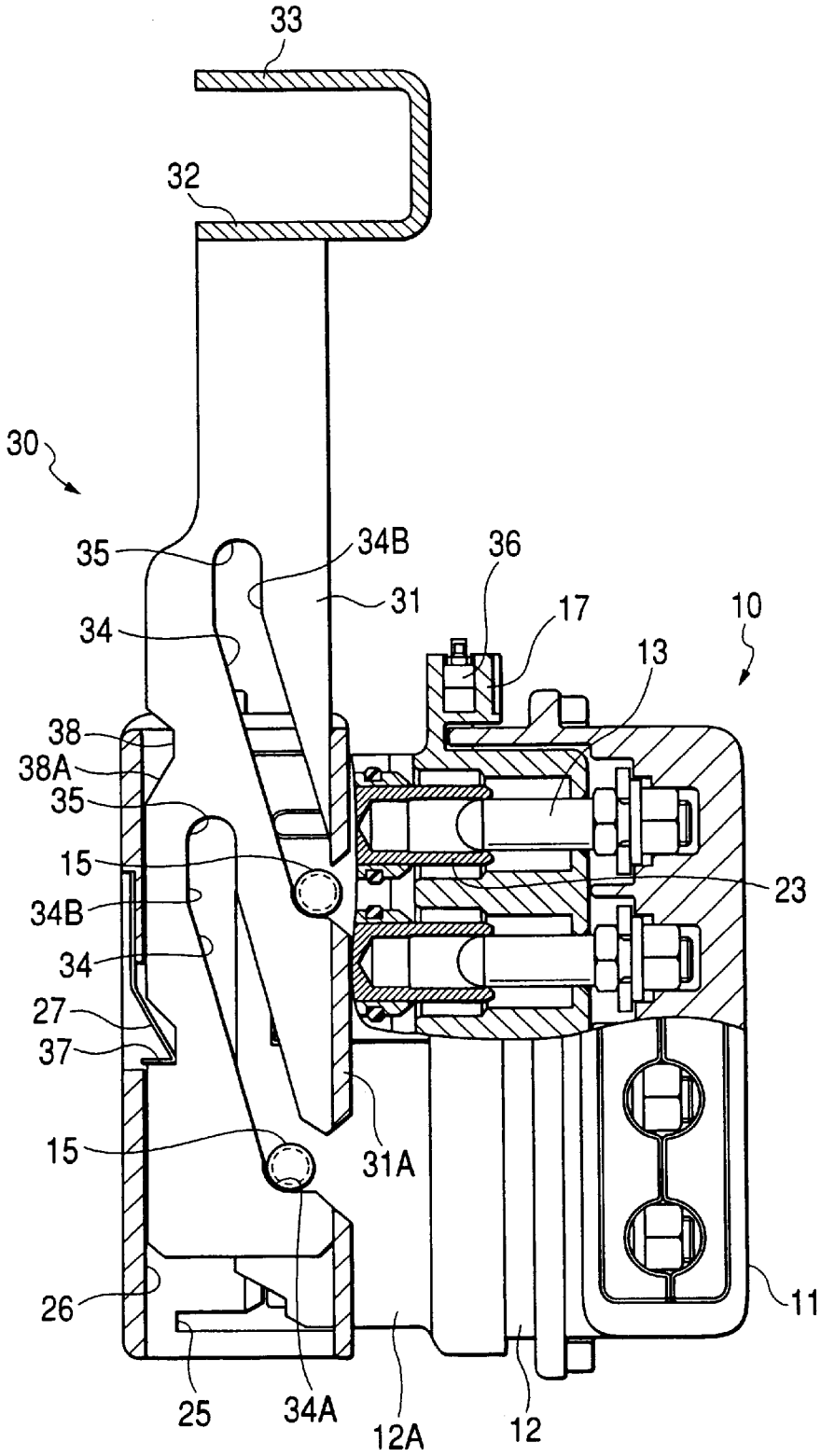
FIG. 2 is a section view of the breaker apparatus, showing the starting state of fitting of the two housings.
Figure 3:
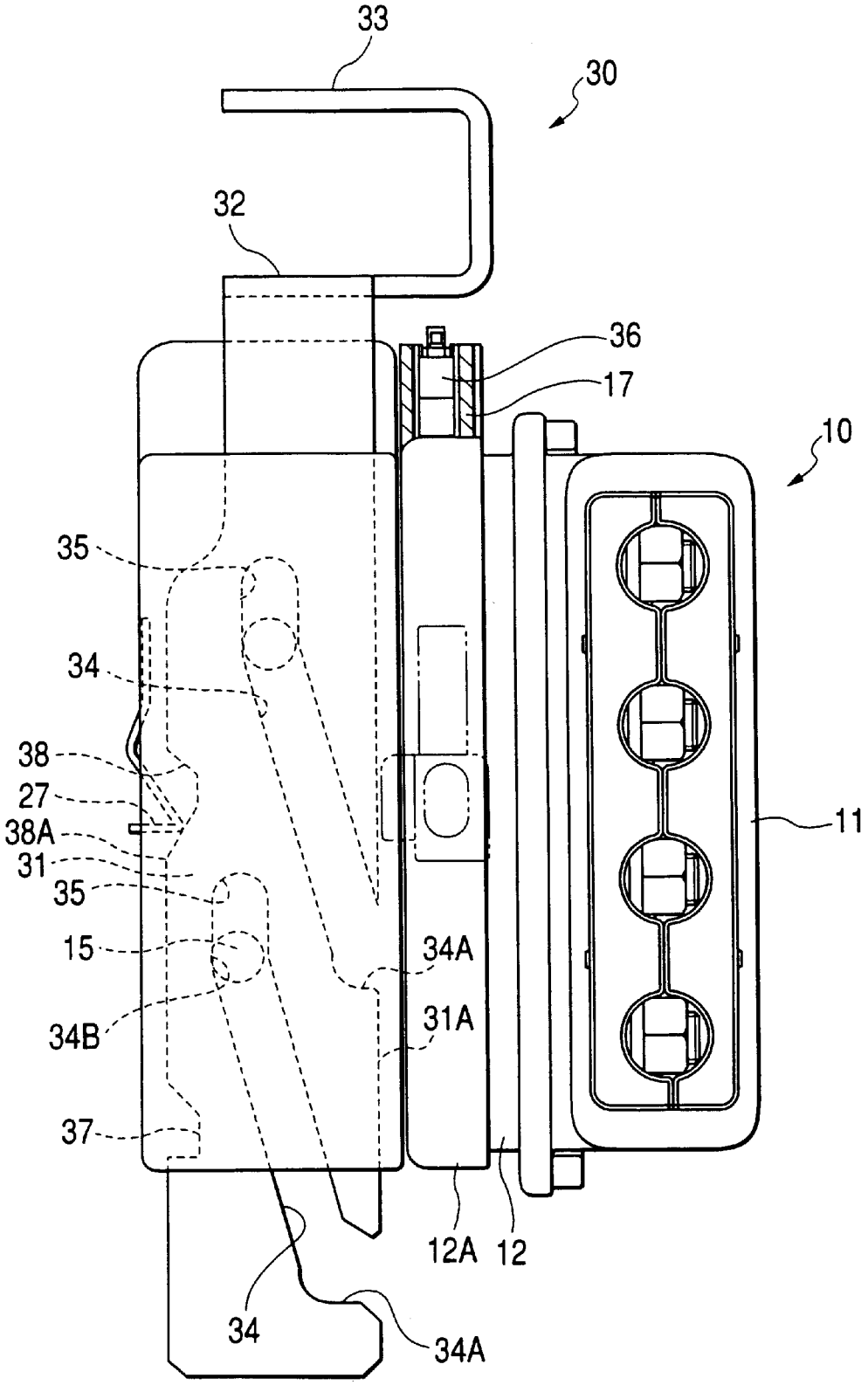
FIG. 3 is a side view of a drive member, showing a state in which it is present at an energization preventive position.
Figure 4:
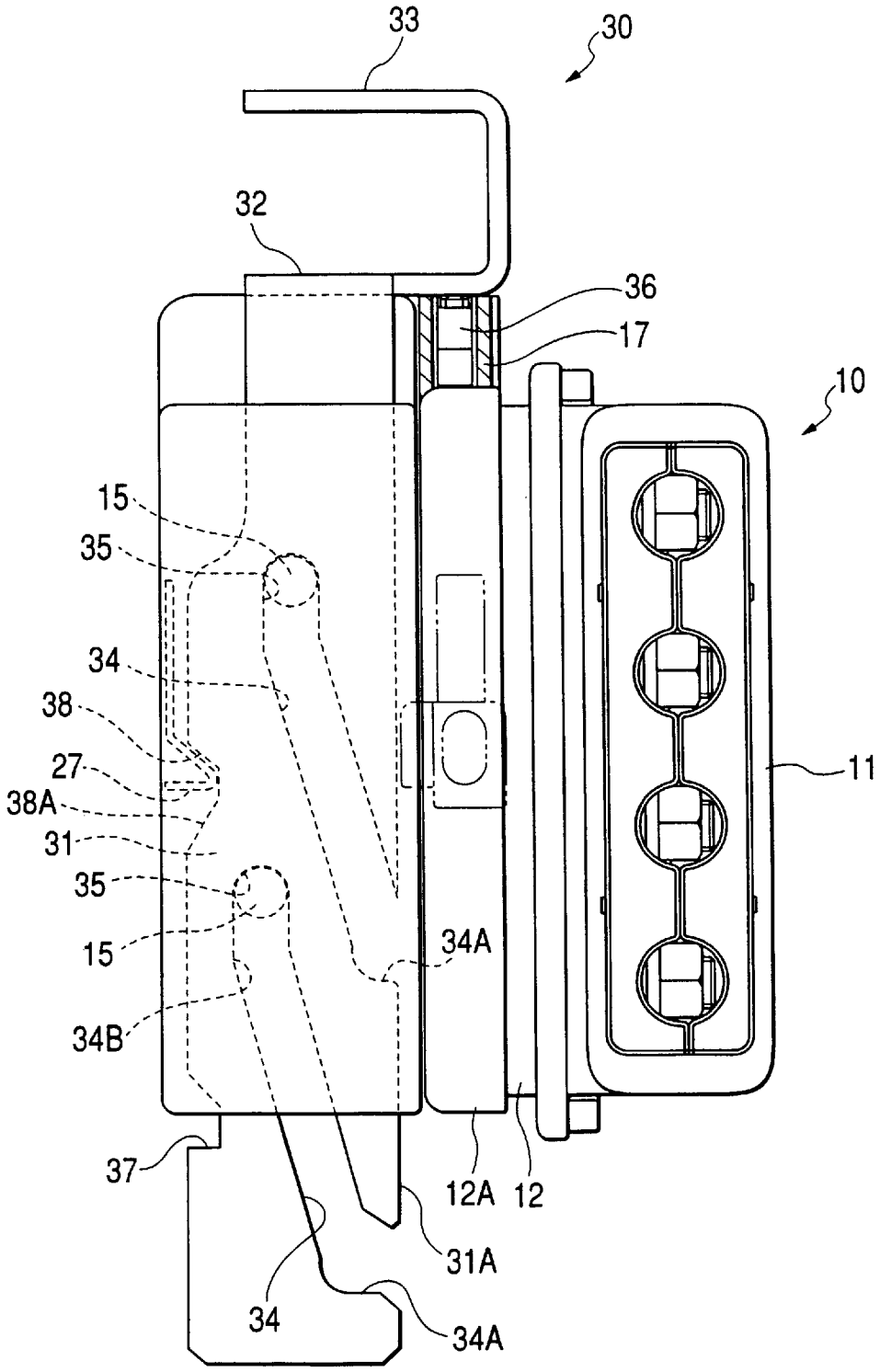
FIG. 4 is a side view of the drive member, showing a state in which it is present at an energization allowable position.
Figure 5A:
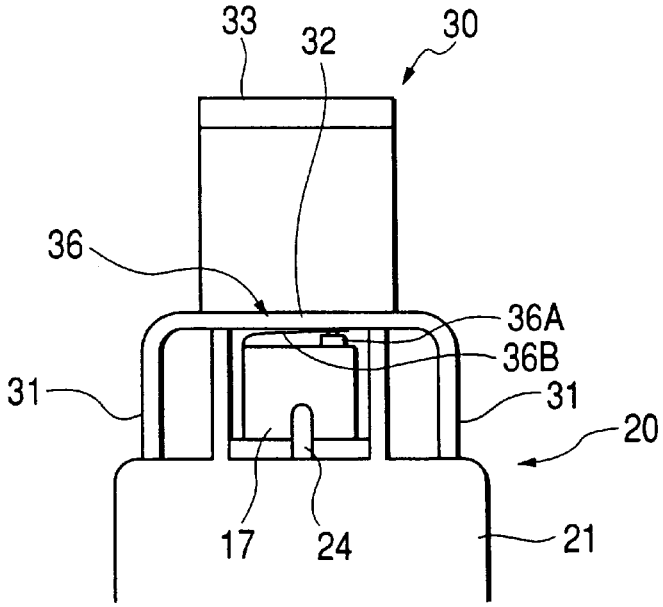
FIG. 5A is a back view of the drive member, showing a state in which it is present at an energization allowable position.
Figure 5B:
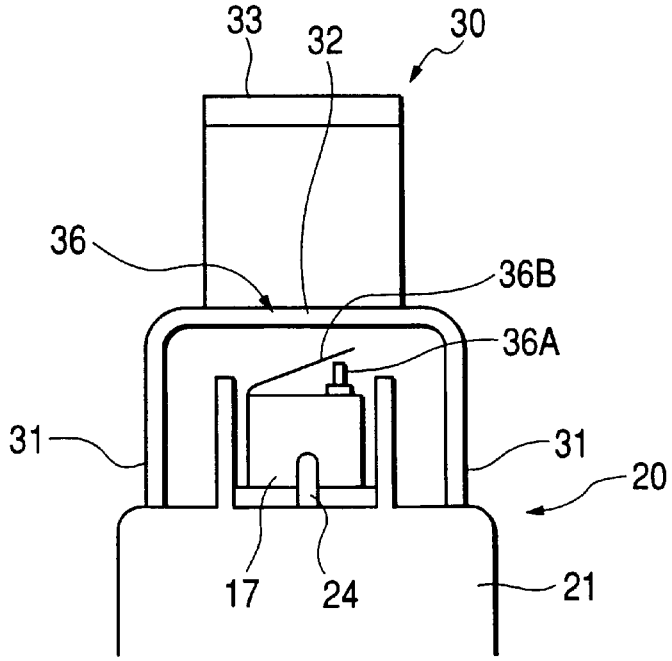
FIG. 5B is a back view of the drive member, showing a state in which it is present at an energization preventive position.

The fixed-side housing 10 is formed in a box shape with the front side thereof corresponding to the left side in FIG. 1 and the side corresponding to the movable-side housing 20. The fixed-side housing 10 comprises a base housing 11, to be fixed to the body of a car, and a cover housing 12 fitted with the open surface of the housing 10. In the base housing 11, a pair of pin-type fixed electrodes 13 are arranged and fixed in upper and lower portions. The fixed electrodes 13 form part of the main circuit (not shown) and, in the case where the two movable electrodes 23 (to be discussed later) are fitted with the fixed electrodes 13, the fixed electrodes 13 are short-circuited, i.e., energization is allowed between the fixed electrodes 13. When the movable electrodes 23 are separated from the fixed electrodes 13, the energization between the fixed electrodes 13 is prevented.

Figure 6:
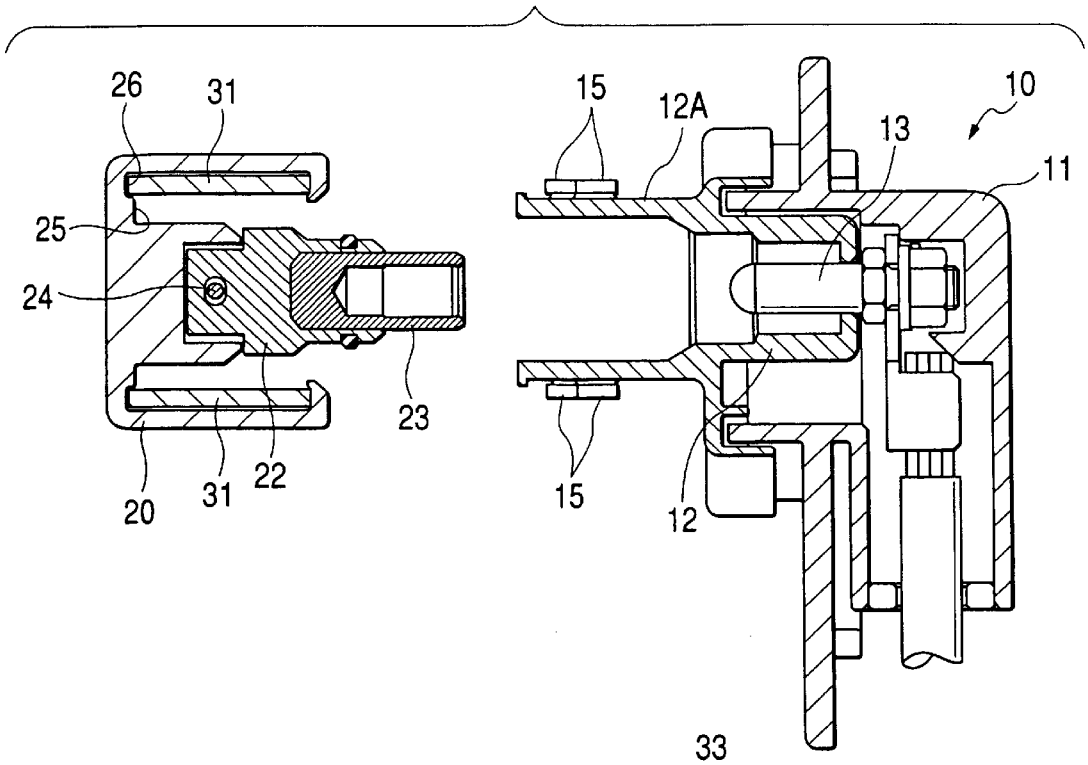
FIG. 6 is a section view taken along the line 6—6 shown in FIG. 1.
Figure 7:
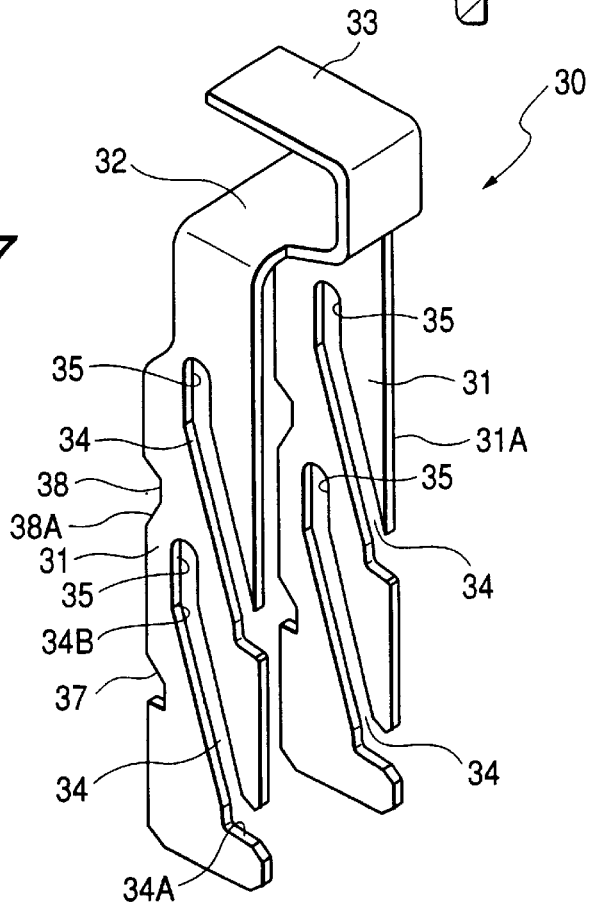
FIG. 7 is a perspective view of the drive member.

In the following description, the term "the vertical direction" is based on FIG. 1, whereas the term "the right and left direction" is the vertical direction of FIG. 6.

In the cover housing 12, there are formed insertion holes 14 into which the fixed electrodes 13 can be inserted respectively. The movable electrodes 23 can be stored in a cylindrical-shaped space between the insertion holes 14 and the outer peripheries of the fixed electrodes 13 (which will be discussed later).

The movable-side housing 20 comprises a cover 21 and two electrode mold bodies 22. Each of the electrode mold bodies 22 includes a pair of movable electrodes 23 molded of resin. When the two housings 10 and 20 are fitted with each other, the movable electrodes 23 are respectively fitted with the pair of fixed electrodes 13. The pair of movable electrodes 23 are connected to each other by a short-circuit piece 23A. Therefore, when the movable electrodes 23 are fitted with the pair of fixed electrodes 13, the movable electrodes 23 allow the fixed electrodes 13 to be short-circuited with respect to each other.

A connecting pin 24 penetrates through the electrode mold body 22 and cover 21 in the vertical direction, whereby the electrode mold body 22 can be mounted on the cover 21 in such a manner that it is prevented against removal. The inside diameter of the penetration hole of the electrode mold body 22 is set slightly larger than the outside diameter dimension of the connecting pin 24. Thus, the electrode mold body 22 is allowed to shake in the vertical direction, as well as in the right and left directions, (in directions at right angles to the fitting and separating direction of the fixed electrode 13 and movable electrodes 23) within the cover 21, so that the alignment of the movable electrodes 23 and fixed electrodes 13 can be adjusted automatically when they are fitted with each other.

In the cover housing 12 of the fixed-side housing 10, there is formed a hood portion 12A (guide means which is an element of the invention) which is open on the upper and front sides thereof (FIG. 1) and has a substantially U-like shape when it is viewed from the front surface side thereof Correspondingly, in the movable-side housing 20, there is formed a substantially U-shaped slit 25 (guide means which is an element of the invention) into which the hood portion 12A can be fitted. When the hood portion 12A and slit 25 are fitted with each other, they fulfil the function of a guide rail. Due to this guide function, the movable-side housing 20 is guided with respect to the fixed-side housing 10 in a direction (in a back-and-forth direction) along the fitting direction of the movable electrodes 23 and fixed electrodes 13. Thus, the movable-side housing 20 is moved in such a manner that the play thereof in the vertical direction as well as in the right and left direction, is restricted.

The fixed-side housing 10 and movable-side housing 20 can be fitted with and separated from each other by the following cam means. That is, a pair of driven pins 15 are provided on and projected from each of the upper and lower portions of the right and left outer surfaces of the hood portion 12A of the fixed-side housing 10. On the movable-side housing 20, there is disposed a drive member 30 which can cooperate with the driven pins 15 in fulfilling the function of a cam.

The drive member 30 includes a right and a left movable plate 31, 31 each having a rectangular-plate shape long in the vertical direction, a plate-shaped connecting portion 32 (a protect portion which is an element of the invention) for connecting together the upper end portions of the two movable plates 31, and a handle portion 33 extending upwardly from the connecting portion 32. The components of the drive member 30 can be formed by press working a sheet of steel plate.

The movable plate 31 is stored in a vertically-extending slit 26 formed in the movable-side housing 20 in communication with the slit 25. It is movable in the interior of the slit 26. The movable plate 31 is allowed to move with respect to the movable-side housing 20 only in the vertical direction (a direction at right angles to the fitting and separating direction of the fixed electrodes 13 and movable electrodes 23) which is the longitudinal direction of the slit 26. However, the relative movements of the movable plate 31 to the movable-side housing 20 in the back-and-forth direction (a direction parallel to the fitting and separating direction of the fixed electrodes 13 and movable electrodes 23) at right angles to the vertical direction, as well as in the right and left direction, are restricted.

Also in the movable plate 31, there are formed two mutually parallel linear-shaped inclined grooves 34 each having a base end portion 34A which is open on the side edge 31 A of the movable plate 31 opposed to the fixed-side housing 10. Each of the inclined grooves 34 is formed such that, as it goes upwardly, it parts away from the side edge 31 A toward the back surface side of the movable plate 31 (in FIG. 2, toward the left side). In other words, it extends in an inclined direction to the relatively moving direction (the vertical direction) of the drive member 30 with respect to the movable-side housing 20. The driven pin 15 of the fixed-side housing 10 can be engaged into the inclined groove 34. When the movable plate 31 is moved in the downward direction (FIG. 1) while the driven pin 15 is introduced into the base end portion 34A of the inclined groove 34, the movable plate 31 and thus the movable-side housing 20 is moved in such a manner that it is drawn close to the fixed-side housing 10 due to the cam action caused by the engagement between the inclined groove 34 and driven pin 15. When the driven pin 15 reaches the terminal end portion 34B of the inclined groove 34, the fitting of the two housings 10 and 20 is completed, as well as the fitting of the movable electrodes 23 and fixed electrodes 13 is completed. Also, when the drive member 30 is lifted up from this position, the movable-side housing 20 is separated from the fixed-side housing 10 and also the movable electrodes 23 are separated from the fixed electrodes 13 due to the cam action caused by the engagement between the inclined groove 34 and driven pin 15.

Further, there is formed in the movable plate 31, a loose fit groove 35 which extends upwardly from the terminal end portion 34B of each of the inclined grooves 34 in parallel to the moving direction of the drive member 30. When the drive member 30 is moved further downwardly from the fit completed position, i.e., where the driven pin 15 is situated in the terminal end portion 34B of the inclined groove 34, the driven pin 15 is moved within the loose fit groove 35 but the cam action is not fulfilled. Therefore, the two housings 10 and 20 are not shifted with respect to each other in the fitting and separating direction. Furthermore, the electrodes 13 and 23 are not shifted with respect to each other in the fitting and separating direction.

On the outer surface of the upper end portion of the cover housing 12 of the fixed-side housing 10, a microswitch 36 is disposed (detect means which is an element of the invention) for detecting the position of the drive member 30 to thereby allow the relay circuit to execute its operation for opening and closing the main circuit. The microswitch 36 is stored in a storage portion 17 which is formed in a cylinder-like shape. The microswitch 36 includes a probe 36A and a movable piece 36B which is disposed upwardly of the probe 36A and can be elastically shifted in the vertical direction.

When the drive member 30 is at an energization allowable position, (see FIG. 4) i.e., where it sets the driven pin 15 at the upper end portion of the loose fit groove 35, the connecting portion 32 presses down the movable piece 36B to bring it into contact with the probe 36A to thereby allow the microswitch 36 to detect that the drive member 30 is at the energization allowable position. Due to this detection, the relay circuit is allowed to execute its closing operation for closing the main circuit. When the drive member 30 moves from the energization allowable position to an energization preventive position (see FIG. 3) in which the driven pin 15 is situated at the terminal end portion 34B of the inclined groove 34, the connecting portion 32 retreats upwardly to separate the movable piece 36B from the probe 36A, just after the start of the movement of the drive member 30, and the microswitch 36 detects the movement of the drive member 30 toward the energization preventive position to thereby allow the relay circuit to start its opening operation for opening the main circuit. After approximately 150 msec. from the start of the opening operation of the relay circuit, the opening operation of the relay circuit is completed so that the main circuit is opened.

Two upper and lower notches 38 and 37 are formed in the side edge of the movable plate 31 on the opposite side to the side edge 31A thereof where the base end portion 34A of the inclined groove 34 is open. When the drive member 30 is in the upper-most end, i.e., where the driven pin 15 is situated at the base end portion 34A of the inclined groove 34 (FIG. 2), the lower notch 37 is fitted with a plate spring 27 (operation resistance increasing means which is an element of the invention) of the movable-side housing 20, so that the drive member 30 is held at the same height. When the drive member 30 is at the energization allowable position (FIG. 4), the upper notch 38 and plate spring 27 are fitted with each other, so that the drive member 30 is held at the energization allowable position. Additionally, when the drive member 30 is at the energization allowable position, the plate spring 27 is contacted with the inclined portion 38A (operation resistance increasing means which is an element of the invention) of the upper notch 38 and is thereby flexed elastically, not only due to the elastic recovery of the plate spring 27 but also due to the inclination of the inclined portion 38A. Therefore, an energization force going toward the energization allowable position side is applied to the drive member 30.

Next, a description will be given below of the operation of the present embodiment.

To bring the movable-side housing 20 into fitting engagement with the fixed-side housing 10, the movable electrodes 23 are moved into the hood portion 12A and are moved laterally until the driven pins 15 move into the base end portions 34A of the inclined grooves 34 of the movable plate 31. In this operation, because the hood portion 12A is open on the upper side thereof, the movable electrodes 23 may be moved down straight from the position shown in FIG. 1 and thereafter, may be moved laterally. As a result, the movable electrodes 23 and fixed electrodes 13 are brought into slight fit with each other.

Next, the drive member 30 is pressed down to the energization preventive position. During this operation, due to the engagement between the driven pins 15 and inclined grooves 34, the two housings 10 and 20 are brought into their mutual fit completed state and the two kinds of electrodes 13 and 23 are brought into their mutual fit completed state to allow energization between the fixed electrodes 13. The main circuit is not closed yet at the time.

Next, the drive member 30 is pressed further down to the energization allowable position. This operation is detected by the microswitch 36 and the relay circuit carries out its closing operation. Thus, the main circuit is turned into its closed state not only due to the closing operation of the relay circuit but also due to the energization allowed state between the fixed electrodes 13, (a state in which energization is allowed). In this state, owing to the engagement between the upper notch 38 and plate spring 27, the drive member 30 is held at the energization allowed position, while the main circuit is held in the closed state.

Additionally, while the drive member 30 remains at the energization prevented position, the further pressing-down operation is not executed (FIG. 3), since the plate spring 27 is elastically contacted with the inclined portion 38A of the upper notch 38. Thus, due to the elasticity and inclination of the plate spring 27, the drive member 30 is automatically moved to the energization allowed position side.

Next, description will be given below of the operation to remove the two housings 10 and 20 from each other.

By picking up the handle portion 33, the drive member 30 situated at the energization allowed position is lifted up. When the drive member 30 is moved toward the energization prevented position, i.e., just after the start of the movement of the drive member 30, the relay circuit begins its opening operation and, after approximately 150 msec., the opening operation of the relay circuit is completed. Accordingly, the main circuit opens to stop the energization between the fixed electrodes.

Here, the distance from the position of the drive member 30 where the relay circuit begins the opening operation to the energization preventive position is set in such a manner that, when the lifting operation of the drive member 30 is carried out at the normal speed, it takes the time longer than about 150 msec. (which is the time lag between the start of the opening operation of the relay circuit and the opening operation of the main circuit) for the drive member 30 to move between the energization allowable and preventive positions. Therefore, when the drive member 30 reaches the energization preventive position, the main circuit is opened. Also, during the time while the drive member 30 starts from the energization allowable position and reaches the energization preventive position, the two housings 10 and 20 are not shifted in the separating direction with respect to each other since the driven pins 15 only move within the loose fit groove 35. Therefore, the electrodes 13 and 23 are also not shifted in the separating direction with respect to each other, thereby maintaining the state where the movable electrodes 23 are removed from the fixed electrodes 13.

After the drive member 30 reaches the energization preventive position, if the drive member 30 is further lifted, the driven pins 15 are engaged with the inclined grooves 34, thereby starting the movements of the movable electrodes 13 in the separating direction from the fixed electrodes 23. When the driven pins 15 reach the base end portions 34A of the inclined grooves 34, the movable and fixed electrodes 13 and 23 are completely separated from each other. When the movable and fixed electrodes 13 and 23 are separated from each other, there is no possibility that there can occur any arc between the movable and fixed electrodes 13 and 23 because the main circuit is already opened due to the opening operation of the relay circuit.

As described above, since the loose fit groove 35 is formed, even in case where there is a time lag between the start and completion of the opening operation of the relay circuit for opening the main circuit, the opening operation of the relay circuit for opening the main circuit can be completed while maintaining the movable and fixed electrodes 13 and 23 in the mutually fitted state.

Also, when the drive member 30 moves from the energization allowable position to the energization preventive position, i.e., during the time when the opening operation of the relay circuit for opening the main circuit starts and the drive member 30 reaches the energization preventive position, the elastic flexion amount of the plate spring 27 increases due to the inclination of the inclined portion 38A of the upper notch 38 and the operation force (operation resistance) to be applied to the drive member also increases gradually. Therefore, a sufficient amount of time may be secured for the start of the opening operation of the relay circuit to the removal of the movable electrodes 23 from the fixed electrodes 13.

When the movable and fixed electrodes 23 and 13 are fitted with each other, the microswitch 36 is covered from above by the connecting portion 32 of the drive member 30. This can prevent the microswitch 36 from being mistakenly operated due to interference by external foreign bodies and thus can prevent the opening operation of the relay circuit for opening the main circuit from being carried out in error.

The invention is not limited to the embodiment explained by the above description and drawings but, for example, the following embodiments also fall within the technical scope of the invention and, further, other various modifications are also possible without departing from the subject matter of the invention.

(1) In the above embodiment, there is employed a structure in which two short-circuited movable electrodes are fitted with the two pin-shaped fixed electrodes. However, this is not limitative but there can also be employed a structure in which a pair of tongue-shaped fixed electrodes are respectively disposed on the two sides of an insulated support pillar, and a U-shaped movable electrode is fitted with the two fixed electrodes to thereby short-circuit the two fixed electrodes.

(2) A fuse device may be attached to the breaker apparatus according to the above embodiment, or there may be disposed a switch which can detect that the movable-side housing is fitted with the fixed-side housing.

(3) In the above embodiment, as the detect means which detects the movement of the drive member to thereby operate the relay circuit, there is used a microswitch. However, according to the invention, alternatively, there may be used a pair of terminal metal members in the fixed-side housing and there may be disposed a short-circuit terminal in the drive member, whereby the short-circuiting of the pair of metal members and the removal of such short-circuiting may be may be carried out using the short-circuit terminal.

(4) In the above embodiment, the microswitch is disposed in the fixed-side housing. However, according to the invention, the microswitch may also be disposed in the movable-side housing.

(5) In the above embodiment, as the switching means, there is used a relay circuit. However, according to the invention, there can also be used other means such as a transistor.

What is claimed is:

1. A breaker apparatus in which a pair of fixed electrodes are disposed in series in a main circuit to be opened and closed by switching means and a movable electrode disposed in a movable-side housing is fitted with and separated from the pair of fixed electrodes to thereby allow or prevent energization between the pair of fixed electrodes independently of the opening and closing operation of the switching means, said apparatus comprising:

a guide for guiding a fixed-side housing with said pair of fixed electrodes disposed therein and a movable-side housing with said movable electrode disposed therein in a fitting and a separating direction of said movable electrode and said fixed electrodes;

a driven pin disposed in said fixed-side housing;

a drive member disposed in said movable-side housing in such a manner that it is prevented from moving in said fitting and separating direction of said movable electrode and said fixed electrodes and is allowed to move in a direction at right angles to said electrode fitting and separating direction;

an inclined groove formed in said drive member, having a base end portion open on a side edge thereof opposed to said fixed-side housing, and inclined with respect to a moving direction of said drive member;

a loose fit groove formed in said drive member and, while said fixed-side electrodes and said movable electrode are fitted with each other, extending in parallel to the moving direction of said drive member from a terminal end portion of said inclined groove where said driven pin is situated; and a detector which allows said switching means to execute a closing operation to thereby close said main circuit when said drive member is present at an energization allowable position for positioning said driven pin in said loose fit groove, and allows said switching means to execute the opening operation to open said main circuit when said drive member moves from said energization allowable position to an energization preventive position for positioning said driven pin in the terminal end portion of said inclined groove.

2. A breaker apparatus as set forth in claim 1, wherein said drive member further comprises a protect portion which, is situated so as to cover said detector while said fixed electrodes and said movable electrode are fitted with each other.

3. A breaker apparatus as set forth in claim 1, further comprising operation resistance increasing means which increases the operation resistance of said drive member, as said drive member moves to said energization preventive position after said switching means starts the opening operation, wherein said detector begins the opening operation of said switching means before the drive member reaches said energization preventive position when said drive member moves from said energization allowable position to said energization preventive position.

* * * * *